US006630779B1

(12) United States Patent
Tökés et al.

(10) Patent No.: US 6,630,779 B1
(45) Date of Patent: Oct. 7, 2003

(54) FLUORESCENT LAMP WITH DISCHARGE TUBE BENT SUBSTANTIALLY IN PLANE

(75) Inventors: József Tökés, Budapest (HU); Sándor Lukács, Veröce (HU); István Würsching, Budapest (HU); László Bánkuti, Budapest (HU)

(73) Assignee: General Electric Company, Schenectady, NY (US)

( * ) Notice: Subject to any disclaimer, the term of this patent is extended or adjusted under 35 U.S.C. 154(b) by 69 days.

(21) Appl. No.: 09/585,299

(22) Filed: Jun. 1, 2000

(51) Int. Cl.[7] ..... H01J 17/16; H01J 63/02
(52) U.S. Cl. ..... 313/493; 313/485
(58) Field of Search ..... 313/493, 634, 313/484, 485, 490, 491, 1; 220/21 R; 362/216; D13/136

(56) References Cited

U.S. PATENT DOCUMENTS

| | | | | |
|---|---|---|---|---|
| 1,984,215 A | | 12/1934 | Hotchner | |
| 3,047,763 A | | 7/1962 | Inman | |
| 3,107,316 A | | 10/1963 | McIlvaine | |
| 4,458,301 A | | 7/1984 | Chapman et al. | 362/216 |
| 5,252,890 A | | 10/1993 | Yasuda | |
| 5,723,939 A | * | 3/1998 | Okuno et al. | 313/1 |
| 6,083,021 A | * | 7/2000 | Lau | 362/216 |

FOREIGN PATENT DOCUMENTS

| | | |
|---|---|---|
| EP | 0 057 974 A | 8/1982 |
| GB | 326 250 A | 3/1930 |
| WO | WO 93 18542 A | 9/1993 |

* cited by examiner

*Primary Examiner*—Nimeshkumar D. Patel
*Assistant Examiner*—Karabi Guharay
(74) *Attorney, Agent, or Firm*—Fay, Sharpe, Fagan, Minnich & McKee, LLP

(57) ABSTRACT

A fluorescent lamp comprises a discharge tube disposed substantially in a plane and shaped at least in part to define a substantial portion of the boundary of a zone in the plane. The part of the tube defining the boundary includes at least one straight portion. The discharge tube has a central axis and sealed ends provided with electrodes and at least two tube sections running substantially parallel to each other. Each tube section has at least one blind-sealed end and the tube sections are connected in series through bridges in the vicinity of the blind-sealed ends to define a single continuous discharge space to be excited by electrical power supplied to the electrodes. A lamp support housing is positioned within the zone and the ends of the discharge tube as well as the blind-sealed ends of the tube sections are re-entrant into the zone. The ends of the discharge tube are received in the lamp support housing. The lamp support housing carries means suitable for mechanically and electrically connecting to a socket and include lead-in wires connecting the electrodes directly or through an operating circuit to the means suitable for electrically connecting to a socket.

9 Claims, 2 Drawing Sheets

FLUORESCENT LAMP WITH DISCHARGE TUBE BENT SUBSTANTIALLY IN PLANE

FIELD OF THE INVENTION

This invention relates to a fluorescent lamp including a discharge tube bent substantially in a plane, and, more particularly, to a lamp construction in which the discharge tube is bent to a shape defining a substantial part of the boundary of a zone in the plane.

BACKGROUND OF THE INVENTION

The luminous output of fluorescent lamps is defined by the mercury vapor pressure in the discharge tube among others. The pressure of the mercury vapor depends on the temperature of the cold spot in the tube which is a place where mercury condenses. Since the electrodes of fluorescent lamps generate heat, the cold spot temperature is influenced by the relative position of the electrodes with respect to the cold spot.

A fluorescent lamp including a discharge tube disposed substantially in a plane and shaped to define a substantial part of the boundary of a zone in the plane is disclosed by U.S. Pat. No. 4,458,301. The discharge tube defines the boundary including at least one straight portion and the ends of the tube are re-entrant into the zone. A lamp support housing, which is disposed within the zone, receives the ends of the tube and provides electrical connection to the electrodes. The cold spot of this type of lamps develops in exhaust tubes inserted in the discharge tube, and its temperature is highly influenced by the operating position of the lamp. The primary reason of it is that the electrodes, which are mounted into both ends of the discharge tube and develop heat while the lamp is operating, lie in the vicinity of the exhaust tubes. Consequently, the temperature of the cold spot is highly dependent on the operating position of the lamp. If the cold spot within exhaust tube is above the electrode, its temperature is higher than if it is under the electrode. Therefore, the optimum operating position of this type of lamps containing liquid mercury is a vertical electrodes up position.

The case is different with amalgam filled lamps where the necessary mercury vapor pressure is defined primarily by the composition of the amalgam and thus a luminous output is obtained which is basically independent from the operating position of the lamp. The drawback of the fluorescent lamp filled with amalgam is the longer warming up period during which the lamp produces only a part of its rated luminous output.

The luminous output of fluorescent lamps is also defined by the electric power consumed by the lamp. This power is proportional to the arc voltage of the lamp voltage which is primarily determined by the geometry and the length of the discharge arc. If a lamp with higher luminous output is needed, while the tube diameter is given, a discharge tube with longer arc length has to be made. However, a discharge tube with longer arc length implies a greater size of the lamp which is still limited by the lamp fixture.

Thus there is a particular need. to provide a fluorescent lamp including a discharge tube disposed substantially in a plane which has a cold spot independent from the operating position of the lamp as well as a higher luminous output at unchanged or smaller overall dimensions.

SUMMARY OF THE INVENTION

In an exemplary embodiment of the invention, a fluorescent lamp comprises a discharge tube disposed substantially in a plane and shaped at least in part to define a substantial portion of the boundary of a zone in the plane. The part of the tube defining the boundary includes at least one straight portion. The discharge tube has a central axis and sealed ends provided with electrodes and at least two tube sections running substantially parallel to each other. Each tube section has at least one blind-sealed end and the tube sections are connected in series through bridges in the vicinity of the blind-sealed ends to define a single continuous discharge space to be excited by electrical power supplied to the electrodes. A lamp support housing is positioned within the zone and the ends of the discharge tube as well as the blind-sealed ends of the tube sections are re-entrant into the zone. The ends of the discharge tube are received in the lamp support housing. The lamp support housing carries means suitable for mechanically and electrically connecting to a socket and includes lead-in wires connecting the electrodes directly or through an operating circuit to the means suitable for electrically connecting to a socket.

This construction has two basic advantages over the fluorescent lamp described in U.S. Pat. No. 4,458,301. One advantage is that the tube sections running parallel to each. other increase the discharge arc length significantly which results in higher lumen output at unchanged or smaller overall dimensions. Another advantage is that well-defined cold spots develop in the vicinity of the bottom portions of the blind-sealed ends since the discharge duct goes through the bridges and does not heat the bottom portions intensively. These cold spots are much farther from the lamp electrodes than the cold spots in the exhaust tubes of the lamp disclosed in the prior art patent. The heat generated by the electrodes exerts much less influence on the cold spots of the lamp provided by the present invention. This ensures cold spots independent from the operating position of the lamp.

DETAILED DESCRIPTION OF THE INVENTION

Figure 1:
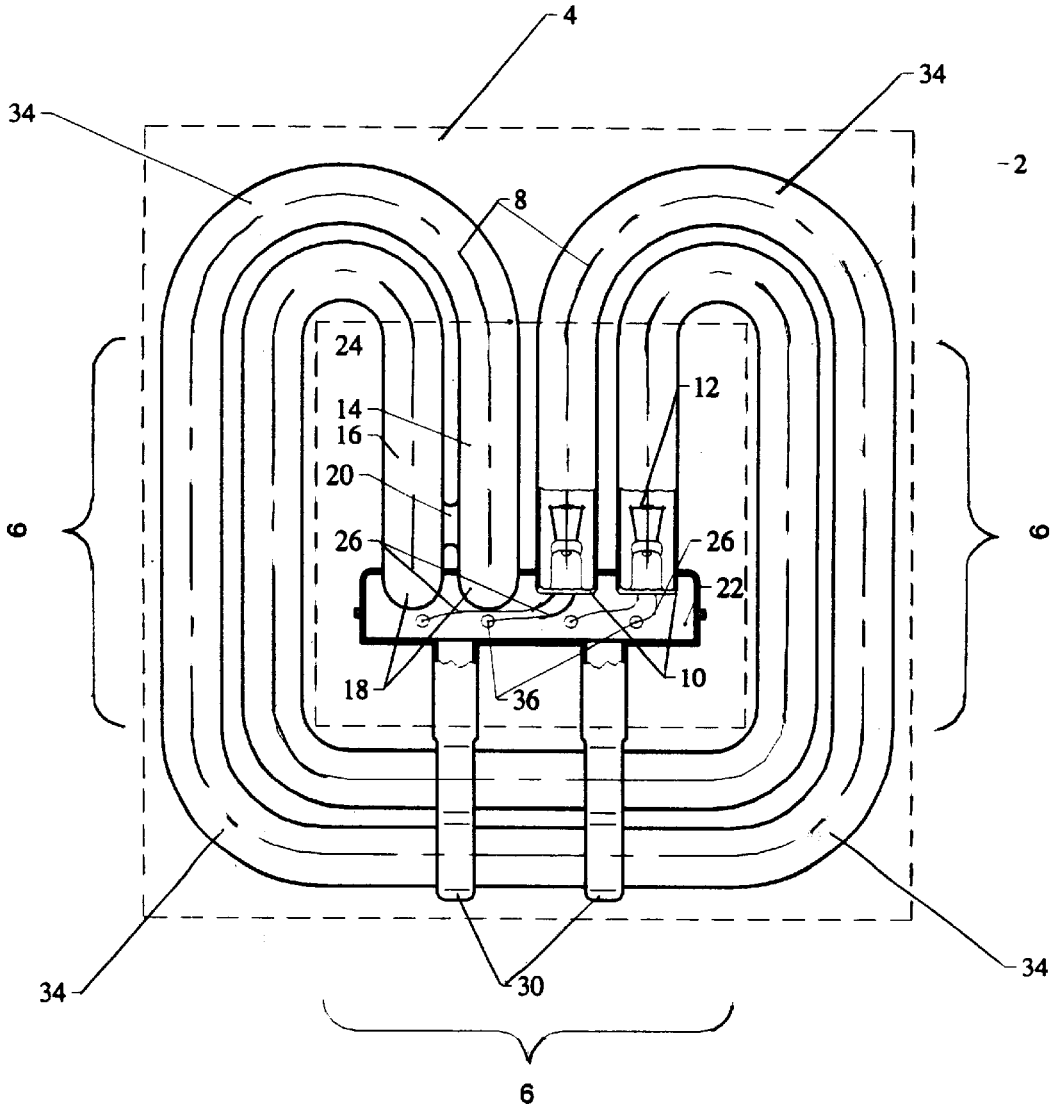
FIG. 1 is a top view in partial cross-section of a fluorescent lamp with a discharge tube bent substantially in a plane.

As shown in FIG. 1, a glass discharge tube 2 is formed from two tube sections 14, 16 bent substantially in a plane. The tube sections have central axes 8 running parallel to each other, and are connected in series through a bridge 20 forming a lamp of dual-2D type. This denomination of type originates from the shape of the glass discharge tube 2 which resembles two upper case D letters standing in a mirror symmetry next to each other. In order to produce visible light, a phosphor coating is deposited on the interior surface of the discharge tube 2 and a suitable gas and additive agents known to experts skilled in the art are filled in the tube 2. The gas fill can be a kind of noble gas, for example argon, to which mercury vapor is dosed for visible light generation. Mercury radiates primarily UV light which is transformed to visible light by the phosphor coating. Each bent tube section 14, 16 includes three straight portions 6 and four arcuate sections 34 defining a substantial portion of a square zone 24. The ends of the tube sections 14, 16 are hermetically sealed by sealed ends 10 and blind-sealed-ends 18. The sealed ends 10 are provided with electrodes 12, while the blind-sealed ends 18 are electrodeless and formed substantially to hemispherical shape. The sealed ends 10 as well as the blind-sealed ends 18 of the tube sections 14, 16 are bent to be re-entrant into the square zone 24 at the fourth side. Lead-in wires 26 are connected to the electrodes 12 in the sealed ends 10 of the discharge tube 2. The ends of the tube sections 14, 16 are approximately parallel to each other.

The discharge tube 2 is provided with a lamp support housing 22 in the central part of the zone 24. The lamp support housing 22 holds the discharge tube 2 and has a construction which permits the discharge lamp to be connected to an energy source. The lamp support housing 22 is formed suitably from plastic, preferably by injection molding. The lamp support housing 22 is provided with openings to accept and fix the ends of the discharge tube 2. The support housing is equipped with terminals 36, and the lead-in wires 26 are connected to these terminals. The ends of the discharge tube 2 are fixed in the lamp support housing 22 by cement or adhesive material. The lamp support housing 22 ensures the mechanical and electrical connection of the lamp to a socket. In the plug-in configuration of the lamp, the lamp support housing 22 is provided with a section enabling mechanical connection to the socket and is also provided with contact pins enabling electric connection thereto. In this configuration, the lead-in wires 26 connect the electrodes 12 to the contact pins directly. In an integral-type configuration of the lamp, an operating circuit is also disposed in the lamp supporting housing 22, and the lead-in wires 26 connect to the contact pins or other means suitable for electrically connecting to the socket through the operating circuit. The socket is not shown in the figure since it does not form a subject matter of the present invention.

In order to release from the stress in the glass discharge tube 2 in the course of plugging the lamp into the socket, two support arms 30 extend from the lamp support housing 22 and are attached to one of the straight portions 6. In the embodiment shown in FIG. 1, the support arms 30 extending from the lamp support housing 22 are attached to each tube section 14,16 running parallel to each other along the straight portion 6 for a more stable gripping of the discharge tube 2.

Figure 2:
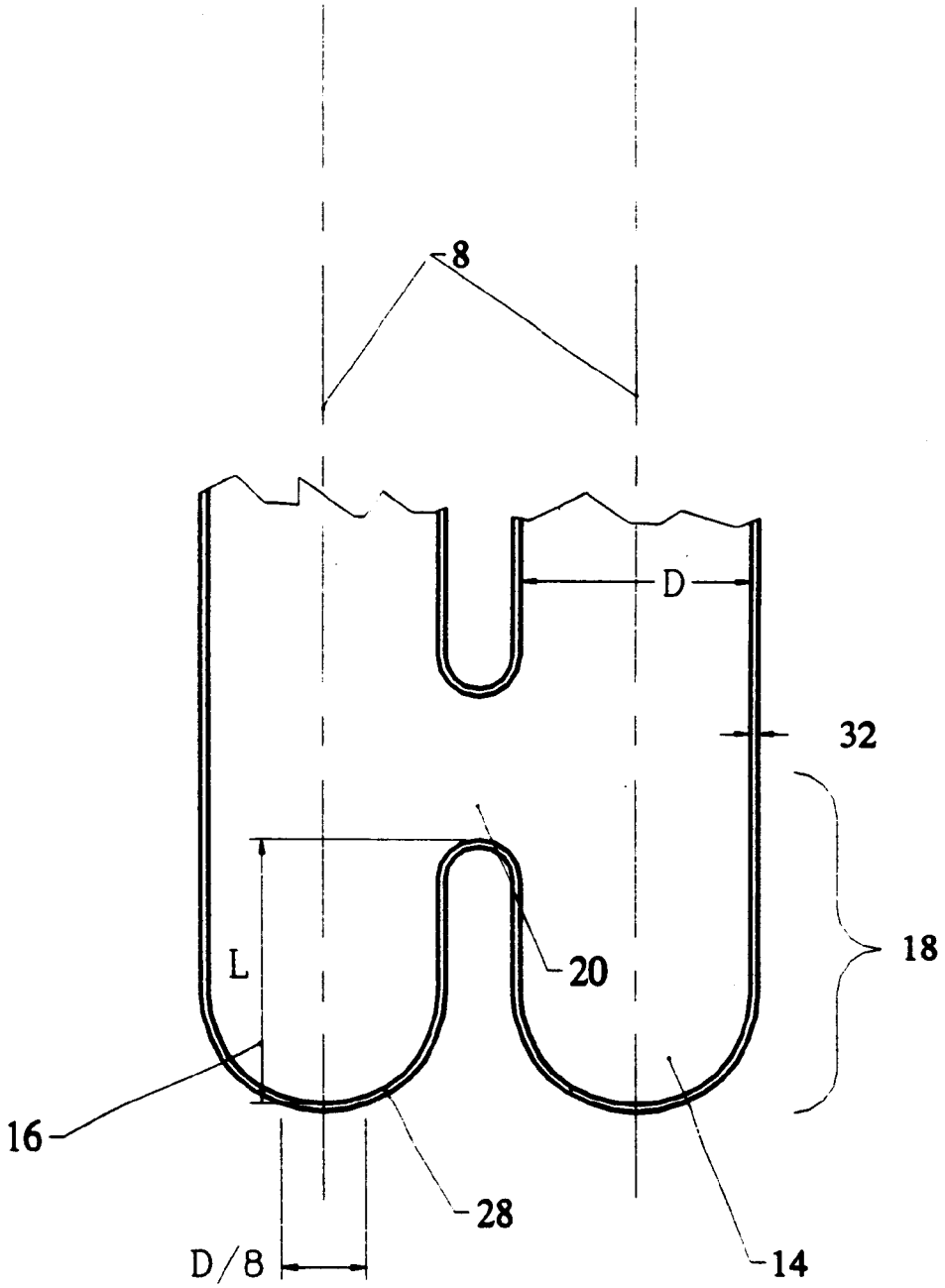
FIG. 2 is an enlarged axial section of blind-sealed ends of the discharge tube of FIG. 1.

Referring now to FIG. 2, the blind-sealed ends 18 of the discharge tube sections 14,16 are connected in series by the bridge 20 which results in a continuous discharge arc duct in the discharge tube 2. The position of the bridge 20 is defined by a distance L measured inside the discharge tube 2 from a wall of the bridge 20 which is closer to the blind-sealed ends 18 to a farthermost point of a bottom portion 28 of the blind-sealed ends 18. The bridge 20 can be formed by blow molding using the technology known from compact fluorescent lamp manufacturing.

In respect of a well-defined cold spot, it is advantageous if the distance L is at least 0.5 D and at most 1.5 D, where D is the inner diameter of the discharge tube 2. The continuous discharge duct, which goes through the bridge 20, can be kept at the distance L from the bottom portion 28, consequently it can heat this portion less, and a well-defined cold spot arises. Owing to the double blind-sealed end configuration of the discharge tube 2, two well-defined cold spots are formed in the vicinity of the blind-sealed ends 18.

In order to provide the cold spots with a better cooling, the wall thickness 32 of the bottom portion 28 of the blind-sealed ends is smaller than the wall thickness of the discharge tube 2. It is also advantageous if the wall thickness 32 of the bottom portion 28 of the blind-sealed ends 18 in a circular section of a diameter of D/8 around the central axis 8 is at most half of the wall thickness 32 of the discharge tube 2. The well defined cold spots allow the mercury vapor partial pressure to be set to a value that corresponds to the highest intensity 253.4 nm resonance line of mercury. The amount of mercury vapor above its liquid phase causing higher partial pressure than the optimum one condenses in these cold spots. On the other hand, when the mercury vapor partial pressure is lower than the optimum one, the appropriate amount of the liquid mercury condensed in the cold spots evaporates. Based on this, the luminous output of the discharge lamp can be set to the maximum value at a given power input rate.

The process of manufacturing a fluorescent lamp of dual-2D type is as follows.

Two linear tubes of length corresponding to the length of the tube sections 14, 16 are provided and coated with phosphor. Each of them is provided with sealed ends 10 and blind-sealed ends 18 at both ends. The sealed ends 10 include the electrodes 12 with the lead-in wires 26. Each tube is heated and bent to form a 2D shape, so that one of them corresponds to an outer tube section 14, the other corresponds to an inner tube section 16. At the places of bending, the arcuate sections 34 are brought about. Then the outer tube section 14 is put above the inner tube section 16 in two parallel planes. Subsequently, the tube sections 14, 16 are heated on spots at a distance from the bottom of their blind-sealed ends 18 with thin flame to melt the glass. The melted spots are punctured with a blow and snouts are obtained. The snouts are put together by moving the tube sections 14, 16 close to each other. During this step, the lower tube section is raised to the plane of the upper tube section, and the snouts are first approached to each other, then moved away from each other in one common plane in order to form the bridge 20 between the two tube sections 14, 16. Finally, the lamp support housing 22 is attached to the discharge tube 2 and the lead-in wires 26 are connected to the terminals 36.

Due to the doubled-length of discharge tube, the fluorescent lamp of dual-2D type provides higher lumen output than a single 2D-type lamp at unchanged overall dimensions. Owing to the well-defined cold spots placed far from the hot electrodes, their temperature becomes independent from the operating position of the lamp which permits a more stable discharge operation compared to the operation of single 2D-type discharge lamps known so far.

Various modifications in structure and/or steps may be made by one skilled in the art without departing from the scope of the claims.

What is claimed is:

1. A fluorescent lamp comprising:

a discharge tube disposed substantially in a plane and shaped at least in part to define a substantial portion of the boundary of a zone in the plane, and part of the tube defining the boundary including at least one straight portion;

said discharge tube having a central axis and sealed ends provided with electrodes and at least two tube sections running substantially parallel to each other, each tube section having at least one blind-sealed end and the tube sections being connected in series through at least one bridge in the vicinity of the blind-sealed ends to define a single continuous discharge space to be excited by electrical power supplied to the electrodes, said discharge tube having a wall thickness, and the wall thickness of a bottom portion of the blind-sealed ends is smaller than the wall thickness of said discharge tube;

a lamp support housing positioned within said zone and the ends of said discharge tube as well as the blind-sealed ends of the tube sections being re-entrant into said zone; and the ends of said discharge tube being received in the lamp support housing carrying means suitable for mechanically and electrically connecting to a socket and including lead-in wires connecting the electrodes directly or through an operating circuit to the means suitable for electrically connecting to a socket.

2. The fluorescent lamp of claim 1 in which the lamp support housing is positioned substantially in a central part of said zone.

3. The fluorescent lamp of claim 1 in which the part defining the boundary includes a plurality of straight portions.

4. The fluorescent lamp of claim 3 in which the part defining the boundary includes three straight portions to form a substantially square zone and the ends of said discharge tube as well as the blind-sealed ends of the tube sections being bent to be re-entrant into the square zone at the fourth side.

5. The fluorescent lamp of claim 1 in which said discharge tube has a substantially uniform inner diameter and the bridges connecting said each tube sections in series are disposed at a distance corresponding to the mathematical relation $$0.5D \leqq L \leqq 1.5D,$$

where

L is said distance measured inside said discharge tube from a wall of the bridge being closer to the blind-sealed end to a farthermost point of said blind-sealed end, and D is the inner diameter of said discharge tube.

6. The fluorescent lamp of claim 1 in which the wall thickness of the bottom portion of blind-sealed ends at least in a circular section around the central axis having a diameter of D/8 is at most half of the wall thickness of said discharge tube, where D is the inner diameter of said discharge tube.

7. A fluorescent lamp comprising:

a discharge tube disposed substantially in a plane and shaped at least in part to define a substantial boundary of a zone in the plane, the part of the tube defining the boundary including at least one straight portion;

said discharge tube having a central axis and sealed ends provided with electrodes and at least two tube sections running substantially parallel to each other;

each tube section having at least one blind-sealed end and the tube sections being connected in series through at least one bridge in the vicinity of the blind-sealed ends to define a single continuous discharge space to be excited by electrical power supplied to the electrodes;

a lamp support housing positioned within said zone and receiving the ends of said discharge tube, and at least one support arm extending from the lamp support housing and attached to one of the straight portion; and the lamp support housing carrying means suitable for mechanically and electrically connecting to a socket and including lead-in wires connecting the electrodes directly or though an operating circuit to the means suitable for electrically connecting to a socket.

8. The fluorescent lamp of claim 7 in which the support arms extending from the lamp support housing are attached to each tube section running parallel to each other along the straight portion of said discharge tube.

9. A discharge tube structure for fluorescent lamps comprising a discharge tube disposed substantially in a plane and shaped at least in part to define a substantial portion of the boundary of a zone in the plane, the part of the tube defining the boundary including at least one straight portion;

said discharge tube having a central axis and sealed ends provided with electrodes and at least two tube sections running substantially parallel to each other;

each tube section having at least one blind-sealed end and the tube sections being connected in series through at least one bridge in the vicinity of the blind-sealed ends to define a single continuous discharge space to be excited by electrical power supplied to the electrodes; and the ends of said discharge tube as well as the blind-sealed ends of the tube sections being re-entrant into said zone.

* * * * *